United States Patent [19]

Leeland

[11] Patent Number: 4,730,421

[45] Date of Patent: Mar. 15, 1988

[54] PITCH BOX

[76] Inventor: David F. Leeland, R.D. 1, Box 150, Denver, Pa. 17517

[21] Appl. No.: 943,604

[22] Filed: Dec. 18, 1986

[51] Int. Cl.[4] ..... E04D 1/36

[52] U.S. Cl. ..... 52/58; 52/219; 285/42; 98/82

[58] Field of Search ..... 52/58–62, 52/218, 219; 285/42–44; 126/314–319; 98/82

[56] References Cited

U.S. PATENT DOCUMENTS

| | | | |
|---|---|---|---|
| 183,300 | 10/1876 | Harmon | 98/60 |
| 288,535 | 11/1883 | Williams | 52/199 |
| 1,263,789 | 4/1918 | Morrison | 285/42 |
| 1,278,120 | 9/1918 | Donnelly | 285/44 |
| 1,442,172 | 1/1923 | Nelson . | |
| 3,461,625 | 8/1969 | Sandow | 52/58 |
| 3,708,185 | 1/1973 | Bilicki et al. | 285/42 |
| 3,871,145 | 3/1975 | Hatmaker | 52/60 |
| 4,010,578 | 3/1977 | Logsdon | 52/58 |
| 4,211,423 | 7/1980 | Resech | 277/212 |
| 4,265,058 | 5/1981 | Logsdon | 52/58 |
| 4,333,660 | 6/1982 | Cupit | 277/9 |
| 4,386,488 | 6/1983 | Gibbs | 52/199 |

FOREIGN PATENT DOCUMENTS

| | | | |
|---|---|---|---|
| 814868 | 6/1959 | United Kingdom | 98/82 |
| 930921 | 7/1963 | United Kingdom | 52/58 |

*Primary Examiner*—James L. Ridgill, Jr.

*Attorney, Agent, or Firm*—Dann, Dorfman, Herrell and Skillman

[57] ABSTRACT

A pitch box for sealing the junction between an upright elongated projection and the opening where it penetrates into the surface of a roof. The pitch box has a central tubular part which has a base adapted to be mounted against the roof surface surrounding the projection and adapted to extend upwardly generally coaxial with the longitudinal axis of the projection to provide a space surrounding the extension for receiving anchoring material. A collar surrounds the upper end of the tubular part and a bottom wall is provided between the bottom of the collar and a median point on the tubular part so that a trough is formed surrounding the upper end of the tubular part. The bottom of the trough has weep holes in it for discharging moisture. The top of the collar extends above the top of the tubular part. A porous material may be used to fill the bottom of the trough and the top of the collar is filled with tar or other sealant material which can be mounded up around the projection which extends upwardly through the pitch box.

10 Claims, 4 Drawing Figures

PITCH BOX

FIELD OF THE INVENTION

The field of the invention relates to roof construction, and has particular application to apparatus for use in making a seal around a pipe or other projection penetrating the roof surface.

BACKGROUND OF THE INVENTION

In the construction of roofs, it is common practice to use flashing components around the perimeter of the roof, and particularly where the roof meets a vertical wall. Where the wall is planar, there is little difficulty in installing flashing which bridges any gap which might exist between the upstanding wall and the roof surface. Where there is a projection through an opening in the roof surface within the perimeter, for example when a vent pipe or air-conditioning conduit penetrates the roof surface, there is difficulty in providing a long-lasting seal between the projecting element and the roof surface, particularly where the projecting element is round or is of irregular contour.

DESCRIPTION OF THE PRIOR ART

Prior to the present invention, the common practice for sealing such projections consists of erecting a dam in spaced relation surrounding the projection and filling up the space between the dam and the projection with pitch or tar so as to effect a weather-proof seal between the roof surface and the projecting element. In many cases, the dam is provided by a pitch box which consists of a ring, circlet, or or other annulus adapted to be mounted on the roof surface with an upstanding wall to provide an annular receiving space surrounding the projection and overlying the opening. In order to firmly anchor the pitch box in place, a thick layer of mortar is deposited within the annulus at the roof level to firmly anchor the pitch box in place and above the mortar, pitch or tar is deposited within the annulus and is mounded up in the center toward the projection so that water running down the projection above the pitch box is deflected away from the surface of the projection.

After a time, the pitch in the pitch box tends to shrink and provide a degree of clearance between the pitch and the pitch box or else between the pitch and the projection. The clearance provides one or more small passages which attract water and permit it to penetrate into the pitch box below the tar and work its way into the opening in the roof structure where the projection penetrates. After a period, the passages may permit a substantial accumulation of moisture surrounding the projection in the opening and on the undersurface of the roof which may manifest itself as leakage into the building.

In an attempt to overcome the problem, gasketing material has been used to effect a seal either between the projection and the pitch box or else between the pitch box and the roof, or both. While effective in the short run, exposure to the elements over a period of time deteriorates the gasketing material and it loses its effectiveness. Furthermore, gasketing is expensive, particularly where the projection is of irregular contour.

SUMMARY OF THE INVENTION

The present invention provides an improved pitch box which enables the roof to be constructed using conventional tools and procedures and yet which provides an improved seal between the roof surface and an element projecting from an opening in the roof surface.

More specifically, the present invention provides an improved pitch box having a configuration which avoids the ill effect of leakage between the pitch and the box which may occur after a period of use.

Even more specifically the present invention provides a pitch box which is designed to divert any leakage which may occur into the pitch box away from the roof opening which the projecting element penetrates.

The preferred embodiment of the invention includes a recessed trough portion in the pitch box spaced outwardly from the projecting element and having weep holes in the bottom thereof so that any leakage within the pitch box is received in the trough and is discharged through the weep holes onto the roof surface for dissipation.

BRIEF DESCRIPTION OF THE DRAWINGS

A preferred embodiment of the present invention is illustrated in the accompanying drawings, wherein.

DESCRIPTION OF A PREFERRED EMBODIMENT

Figure 1:
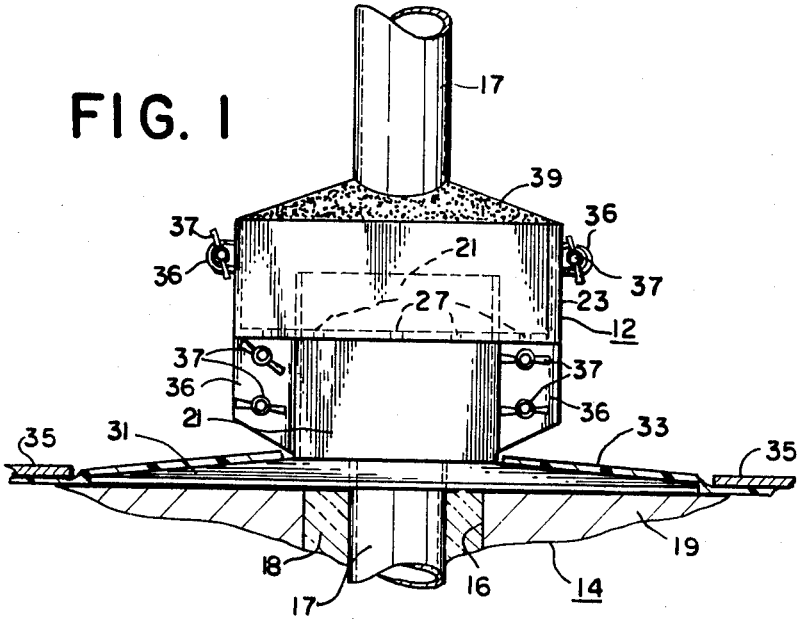
FIG. 1 is a side elevational view of a pitch box installed on a flat roof, the roof being shown in section.

With reference to the drawing, FIG. 1 illustrates a pitch box 12 made in accordance with the present invention applied to a roof 14 of substantially standard construction. The roof has an opening 16 through which a projection, in the present instance a vent pipe 17, penetrates. In accordance with the usual practice, insulation material 18 is stuffed into the opening 16 between the walls of the opening and the pipe 17. The body of the roof 14 may be of any suitable construction providing a flat surface 19 immediately surrounding the opening 16 on which the pitch box 12 may be mounted.

As shown in the drawings, the pitch box 12 is annular in form having a square tubular core 21 extending from its lower limit upwardly a substantial distance. The core 21 has a hollow center which is sufficiently larger than the diameter of the vent pipe 17 to accommodate filler material 22 between the core 21 and the vent pipe 17.

At the upper end, the pitch box is provided with an annular collar 23 spaced radially outward from the core 21 and overlapping the upper marginal end of the core 21. Preferably, the collar 23 comprises a hollow square which is coaxial with the core 21 and with the vent pipe 17 so as to provide a peripheral annular channel or trough 25 between the core 21 and the collar 23. A bottom wall 26 is provided to define the lower limit of the channel 25 and extends from the bottom of the collar inwardly to meet the core 21 at a position spaced below its upper end. As set forth more fully hereinafter, the bottom wall 26 is preferably horizontal and has a series of weep holes 27 positioned along the lowest part therein.

Figure 2:
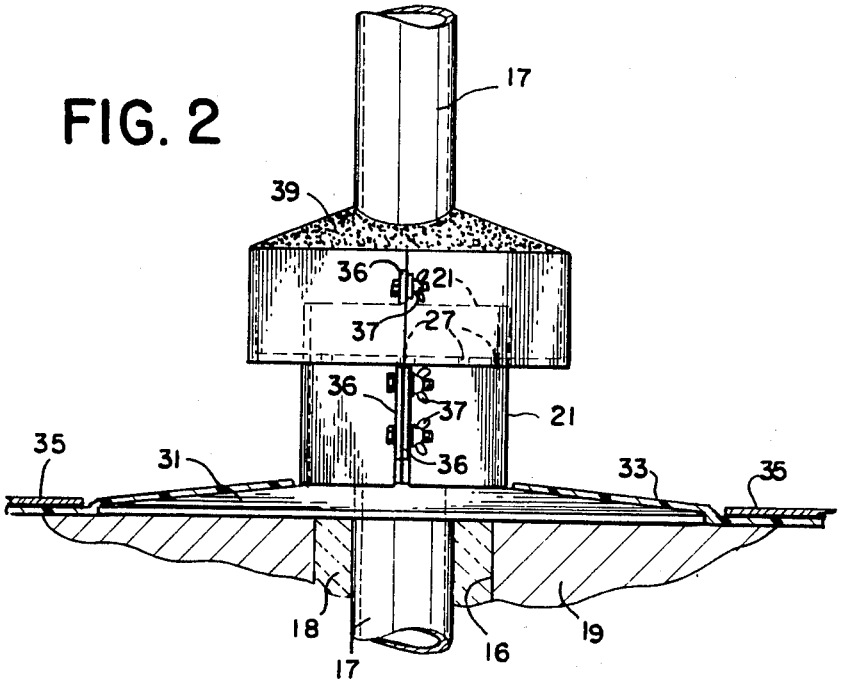
FIG. 2 is a plan view of the pitch box of FIG. 1 with the flashing and the roofing membrane broken away.
Figure 3:
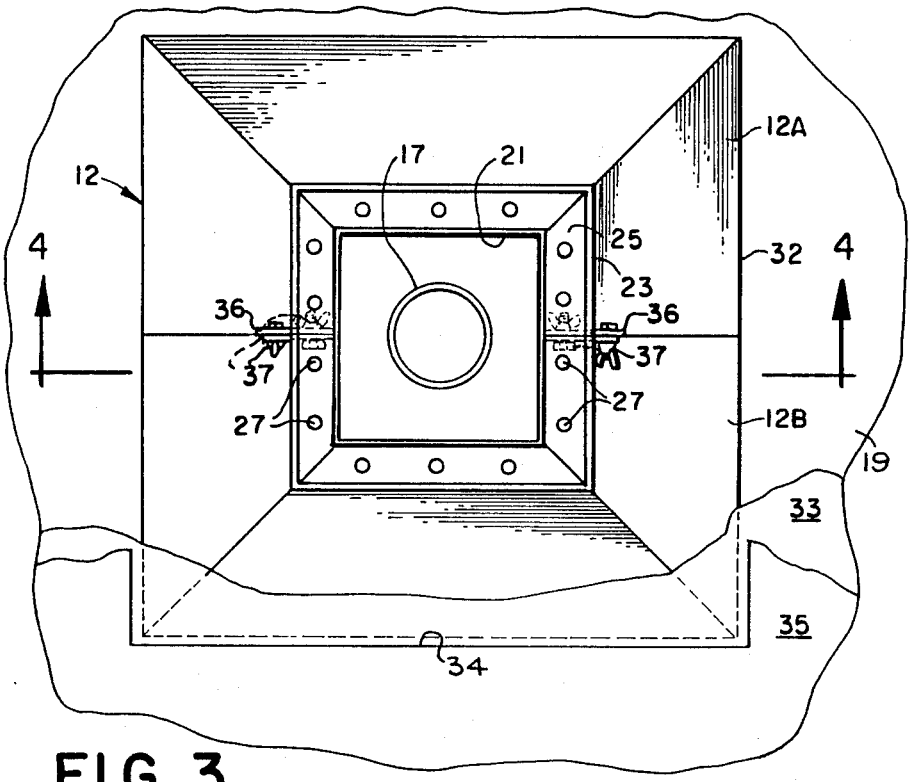
FIG. 3 is a plan view of the pitch box shown in FIGS. 1 and 2, but with the filler material and the sealant removed for the purpose of illustrating the interior construction of the box.

At its base, the core 21 merges into an outwardly-annular base or flange portion 31 having a flat portion adapted to bear against the upper surface of the roof structure 19 to support the core portion 21 with its central axis disposed vertically, coaxial with the axial center line of the pipe 17. The central axis of the tubular core portion 21 is set at an angle to the bottom of the base 31 which corresponds to the angle which the axis of the projection 17 makes with the surface of the roof 19. As shown, the thickness of the base flange portion 31 tapers from a substantial thickness adjacent the core 21 to an edge 32 at its outer perimeter which is formed by the upper surface meeting the lower surface at an acute angle. In order to bridge any clearance gap between the base 31 and the roof structure 19, a sheet flashing material 33 is secured to the upper surface of the base 33 and extends past the edge 32 onto the upper surface of the roof structure 19. The sheet material may be elastomeric and cemented in place, or may be formed otherwise to assure a substantially water-tight joint between the base 31 and the roof 19. The roof 19 may include a roofing membrane 35 (not shown in FIG. 2) which overlies the flashing 33. Preferably, the roofing membrane has a cutout 34 to accommodate the pitch box so that the periphery of the cutout registers closely with the edge 32 of the base portion 31.

In order to facilitate manufacture of the pitch box and mounting of the pitch on the roof around the projection, the box 12 is preferably molded in complementary parts 12A and 12B. When engaged face to face, the two parts form the annular pitch box structure 12. Each part is provided with diametrically-opposite mating flanges or ears 36, 36 having apertures therein adapted to register to accommodate fasteners 37 which may be tightened and released to assemble and disassemble the pitch box in position around the vent pipe 17 prior to final installation. The plastic material of which the box is molded is weather-resistant when set, and is not subject to degradation due to exposure to sunlight, heat, cold, rain, snow, and the like.

Figure 4:
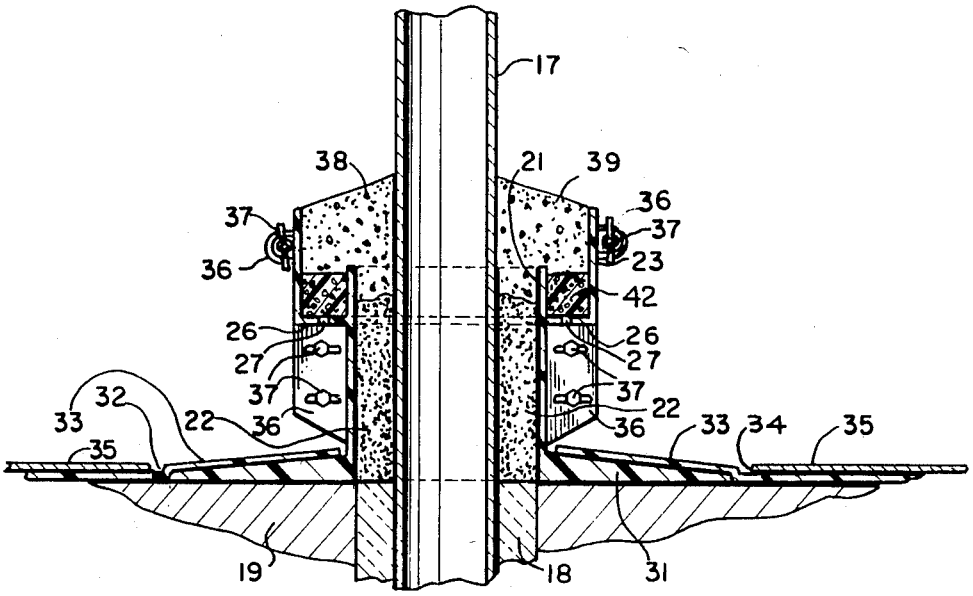
FIG. 4 is a sectional view taken along the line 4—4 of FIG. 3.

When the pitch box 12 is assembled, and mounted in place, filler material 22 is positioned into the space between the vent pipe 17 and the tubular part 21 of the pitch box, and as shown in FIG. 4, is preferably poured in place and allowed to set. Roof mortar is a suitable filler material to use to anchor the pitch box in place around the vent pipe. Preferably, the anchoring material is filled to a level below the top of the tubular part 21 so as to expose the upper terminal edge of the tubular part in the space within the collar 23.

When the anchor material is in place, the space above the material 22 is filled with tar, pitch or another suitable pourable viscous waterproof material which sheds water and may adhere to the material of the pitch box and to the material of the vent pipe. Roofing tar is a suitable material and as shown in FIG. 4, the roofing tar 38 is mounded up above the top of the collar 23 to provide a run-off surface 39 extending downwardly from the vent pipe to the top of the collar 23. Thus, moisture which may accumulate by condensation or by precipitation on the vent pipe 17 may run down the pipe until it engages the surface 39 which then deflects the moisture to cause it to run to the outside of the collar 23 of the pitch box where it may run down and drip onto the flashing 33 and be dissipated on the roof surface.

In use, after a prolonged period of installation, it is not unlikely that the tar filler 38 may shrink and separate from the interior wall of the pitch box collar 23 allowing moisture running down the surface 39 to enter the space between the tar 38 and the collar 23. Any moisture entering this space will then enter the trough 25 and may travel down to the bottom of the trough to the weep holes 27 which afford discharge of the accumulated moisture through the weep holes onto the upper surface of the flashing 33 where it may then be dissipated over the roof. The upper terminal end of the tubular part 21 serves as a barrier against the moisture travelling into the interior of the tube 21 where it may adversely affect the anchor material 22 or the insulation 18.

It is preferable to fill the bottom of the trough with a closed-cell porous material 42 to facilitate the passage of any accumulated moisture within the trough outwardly through the weep holes. The use of a closed-cell material at the bottom of the trough assures gravity flow of moisture to the bottom of the trough where it may be discharged through the weep holes, and reduces the likelihood of moisture flowing up the tubular wall 21 by surface tension or capillary action and entering the clearance space between the pipe 17 and the tubular part 21. The material 42 also prevents clogging of the weep holes 27, so that the material 42 does not adversely affect the capability of the sealing material 38 to prevent leakage downwardly through the pitch box.

In order to enhance the protection of the anchor material 22 and the insulation 18, the parts 12A and 12B are preferably cemented together along their junction line and the base 31 is cemented and fastened with screws to the roof structure 19.

As is apparent from the foregoing description and the drawings, the present invention permits the vent pipe 17 to be sealed within the opening 16 regardless of the condition of its outer periphery. For example, if the vent pipe is of irregular outline, or has been dented or damaged, the anchor material 22 and the sealing material 38 accommodate to such irregularities to ensure against leakage between the vent pipe and the surrounding material.

Although a particular embodiment of the present invention has been herein illustrated and described, it is not intended to limit the invention to such disclosure, but changes and modifications may be made therein and thereto within the scope of the following claims.

What is claimed :

1. For constructing and repairing roofs, in combination with a roof having an opening and a projecting element penetrating into said opening, a pitch box for sealing the junction between said element and said opening comprising:

a tubular body surrounding said projecting element and said opening with clearance between the outer surface of said element and the inside surface of said tubular body;

said body having an upright axis and terminating at its lower end in a base bearing flush against said roof surface around said opening, and terminating at its upper end in a free marginal end portion; and a collar surrounding said free marginal end portion in radially spaced relation thereto to provide an annular trough between said free marginal end portion of said body and said collar, said trough having a bottom wall means spaced above said base and below the upper end of said body, said wall means having a plurality of weep holes affording discharge of moisture from said trough through said weep holes, said collar extending above the level of said upper end of the tubular body so as to accommodate a waterproof sealant material extending from the interior surface of said collar to the exterior surface of said projecting element above the upper end of said tubular body.

2. A pitch box combination according to claim 1 wherein said tubular body and said collar are square in cross section.

3. A pitch box combination according to claim 1 wherein said pitch box is separated along a plane including its upright axis into two parts, and including means to fasten said two parts together around said projection.

4. A pitch box combination according to claim 1 wherein said base comprises a flange portion projecting outwardly from said body at its lower end, said flange having a planar undersurface to bear flush against said roof surface, said flange tapering in thickness toward its outer perimeter, and terminating in an acute angular edge along said perimeter.

5. A roof assembly comprising a combination according to claim 1, including an anchoring material filling the clearance between the outer surface of said element and the inside surface of said tubular body, means overlying the bottom wall means of said trough to afford flow passages for moisture through said weep holes, and a sealant material overlying said anchor material and filling the space between the inside of the collar and the outside of said projecting element and being mounted up around the projecting element to provide a moisture-run-off surface directing moisture away from said projecting element toward said collar.

6. A roof assembly according to claim 5 wherein said base comprises a flange portion projecting outwardly from said body at its lower end and terminating in an edge about its periphery, the underside of said flange bearing flush against said roof surface, said assembly including flashing overlying the roof surface beyond said edge and overlying the flange about its periphery, and a roofing membrane having a cut-out conforming to the periphery of said flange and surrounding the same in a position overlying said flashing.

7. A roof assembly according to claim 5 wherein said means overlying said bottom wall means comprises a porous material filling the bottom of the trough, said sealant material overlying said porous material within said trough, said porous material causing said sealant material to be spaced above said weep holes.

8. A roof assembly according to claim 5 wherein said free marginal end portion of said tubular body extends a preselected distance above said bottom wall means, said porous material having a depth less than said preselected distance.

9. A roof assembly according to claim 8 wherein said anchor material comprises roof mortar partially filling the interior of said tubular member and extending from the roof opening upwardly to a level below the marginal end portion of said tubular body, whereby said sealant material encases said marginal end portion above said porous material on the outer surface and above said anchor material on the inner surface.

10. A pitch box comprising a molded structure formed of a plastic material which is weather resistant when set and is not subject to degradation due to exposure to sunlight, heat, cold, snow and the like, and said structure comprising an upright tubular body having a base at its bottom with a flange projecting outwardly therefrom, a bottom wall projecting outwardly from said tubular body above said base and flange and below the top of the tubular body and extending to its outer perimeter, and a collar extending upwardly from the outer perimeter of said bottom wall a distance to a height above the top of the tubular body, said bottom wall having perforations within said outer perimeter overlying said flange between said tubular body and said collar.

* * * * *